United States Patent [19]

Rodi et al.

[11] Patent Number: 5,010,812

[45] Date of Patent: Apr. 30, 1991

[54] ELECTRONIC DEVICE FOR CONTROLLING A PRINTING MACHINE

[75] Inventors: Anton Rodi; Udo Blasius, both of Leimen; Jürgen Reithofer, Nussloch; Karl-Heinz May, Viernheim, all of Fed. Rep. of Germany

[73] Assignee: Heidelberger Druckmaschinen AG, Heidelberg, Fed. Rep. of Germany

[21] Appl. No.: 397,374

[22] Filed: Aug. 22, 1989

Related U.S. Application Data

[63] Continuation of Ser. No. 47,017, May 5, 1987, abandoned, which is a continuation-in-part of Ser. No. 770,702, Aug. 29, 1985, abandoned, which is a continuation-in-part of Ser. No. 445,243, Nov. 29, 1982, abandoned.

[30] Foreign Application Priority Data

Nov. 28, 1981 [DE] Fed. Rep. of Germany ..... 3147312

[51] Int. Cl.[5] ..... B41F 31/04; B41F 13/12

[52] U.S. Cl. ..... 101/148; 101/365

[58] Field of Search ..... 101/350, 349, 365, 363, 101/351, 352, 207, 181, 208, 209, 210, 148; 340/707, 708, 754

[56] References Cited

U.S. PATENT DOCUMENTS 3,474,438 10/1969 Lauher ..... 340/703
3,760,373 8/1973 Bartz ..... 340/707 X
3,768,073 10/1973 Rawson et al. ..... 340/707 X
3,898,643 8/1975 Ettlinger ..... 340/707 X
3,930,447 1/1976 Murray ..... 101/365
4,238,792 12/1980 Cohen et al. ..... 340/707
4,329,923 5/1982 Iida ..... 101/365

FOREIGN PATENT DOCUMENTS 2830085 1/1980 Fed. Rep. of Germany ..... 101/365

*Primary Examiner*—J. Reed Fisher

*Attorney, Agent, or Firm*—Herbert L. Lerner; Laurence A. Greenberg

[57] ABSTRACT

Data entry and display apparatus for a printing machine having a plurality of control elements having actual and desired position values for controlling machine variables which include ink and dampening fluid density and register positions, the control apparatus includes a control panel having a plurality of optical first elements for displaying and controlling at least one of the machine variables; a light pen having a contact point which includes a second optical element for operatively, optically engaging the first optical elements; timing means operatively engaging the first and second optical element for timingly coordinating the position of the contact point in spaced relationship with the first optical elements for entering nominal position values for at least one of the control elements into the control apparatus.

32 Claims, 8 Drawing Sheets

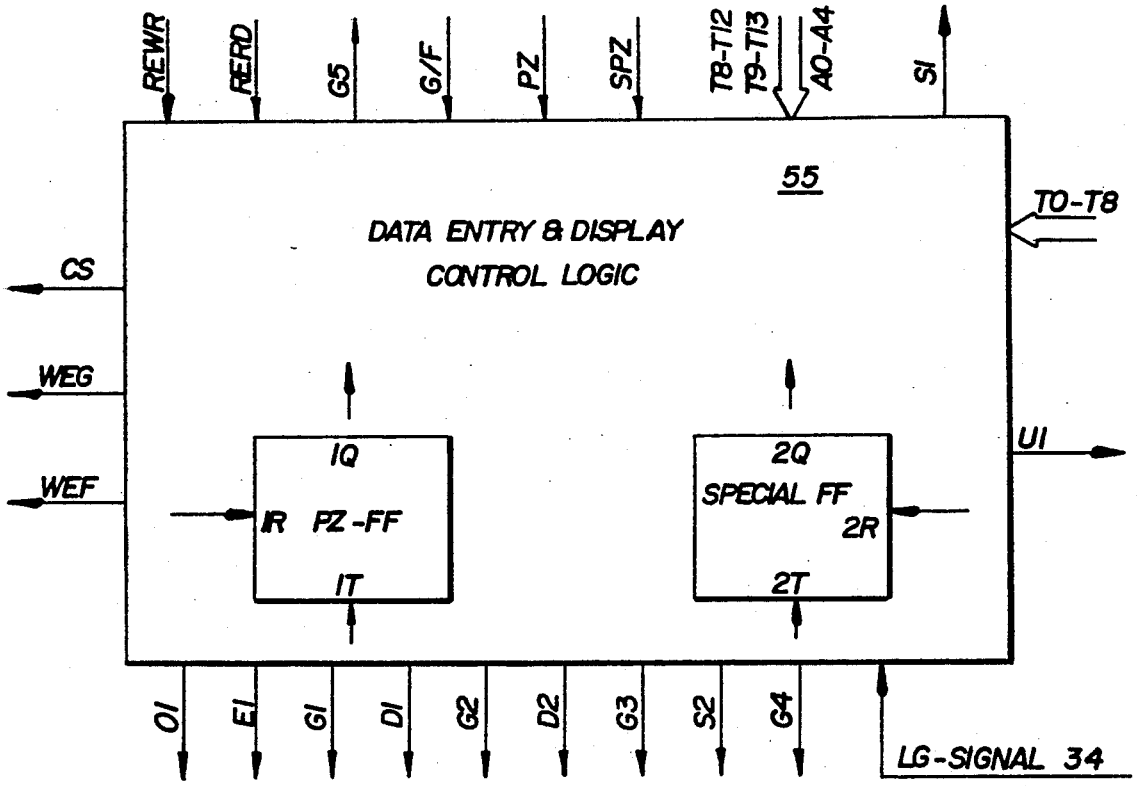

FIG. 10a $$
\begin{cases}
G1 = REWR + RERD \\
D1 = RERD \\
G2 = G1 \cdot \overline{SPZ} \cdot \overline{LGZ} \\
LGZ = T7 \cdot \overline{G/F} \cdot \overline{T8} \\
D2 = LGZ \\
G3 = LGZ \cdot (PZ + SPZ) \\
S2 = \overline{T8} \cdot GF \cdot T7 \\
G4 = \overline{LGZ} + LEE \cdot (PZ + SPZ) \\
LEE = \overline{T2} \text{ (FIG.5a LED-ENABLE)} \\
SI = \overline{G/F} \\
G5 = \overline{G1} \\
UI = \overline{G/F} \\
E1 = \overline{2Q} \\
O1 = \overline{G1} \cdot SPZ \cdot LGZ \\
CS = G1 \cdot WEG + WEF + \overline{LGZ} \\
WEG = REWR + (PZ + SPZ) \cdot \overline{G/F} \cdot \overline{T7} \cdot WE \\
WEF = REWR + (PZ + SPZ) \cdot \overline{G/F} \cdot \overline{T8} \cdot \overline{T7} \cdot WE \\
WE = 1Q + LGE \cdot T3 \cdot T4 \cdot T5 \cdot T6 \cdot \overline{T7} \cdot SPZ \cdot LGZ \cdot 2Q \\
1T = \overline{GF} \cdot \overline{T8} \cdot \overline{T7} \cdot PZ \cdot LGE \cdot LG \\
2T = \overline{GF} \cdot \overline{T8} \cdot \overline{T7} \cdot SPZ \cdot LGE \cdot LG \\
LGE = T1 \oplus T2 \text{ (FIG.5a LG-ENABLE)} \\
1R = \overline{LGZ} \cdot \overline{PZ} + LGR \\
2R = A0 \cdot A1 \cdot A2 \cdot A3 \cdot A4 \cdot \overline{LGZ} + \overline{SPZ} \\
LGR = \overline{T0 \cdot T1 + LGE} \text{ (FIG.5a LG-FF-RESET)}
\end{cases}
$$

FIG. 10b

ELECTRONIC DEVICE FOR CONTROLLING A PRINTING MACHINE

This application is a continuation of application Ser. No. 047,017, filed May 5, 1987, now abandoned, which is a continuation-in-part of application Ser. No. 770,702, filed Aug. 29, 1985, which is a continuation-in-part of application Ser. No. 445,243, filed Nov. 29, 1982, now abandoned.

BACKGROUND AND OBJECT OF THE INVENTION

The invention relates to a method and device for entering and displaying data for controlling a printing machine, especially for data for controlling a plurality of servomotors for adjusting machine control elements for the ink film thickness profile and the dampening-fluid film thickness profile and for the register adjustment positions of an offset printing machine.

In a conventional printing machine control panel, it is known that the actual positions of the controlling elements, in this case the positions of the servomotors for the elements may be indicated by means of a matrix of light-emitting diodes on a display panel. The servomotors for the individual ink cylinders can be switched on by the machine operator by means of pushbuttons or keys on the control panel so that the operator can selectively adjust the position of the ink-control elements. Furthermore, a device is known wherein desired values for the position of the ink-control elements can be entered into the control panel and wherein the ink-control elements are subsequently automatically adjusted until they reach the desired position. The desired values can be introduced manually, for example by means of potentiometers. These desired values are entered in order, for example, at the beginning of a printing job, to preset the ink-controlling elements of the printing machine, in which case the desired values may, for example, have been obtained from a previous, identical printing job. The desired values, however, may alternatively be entered by the machine operator during the job in progress in order to overcome undesirable ink feed deviations in the printed product which might, for example, result from ambient temperature changes.

It is accordingly an object of the invention to provide a method and device for entering and displaying data controlling a printing machine, wherein the machine operator can enter data and control commands and variations thereof, in a very simple and rapid fashion.

It is another object of the invention to provide such a device wherein the control panel serves simultaneously to indicate the information as it is being entered, and in particular wherein the control panel at least indicates actual position values for the ink-control elements. The section of the control panel providing such indication is referred to hereinafter as the display panel. It is possible that the entire control panel is a display panel.

It is further an object of the invention to provide such a method and device wherein the entering of data and control commands is simple and rapid. For example, if the operator has to enter new or changed desired position values for individual, several or all the ink-control elements, he is merely required to pass a light pen over the display panel and he does not have to operate a screw or pushbutton or key or the like for each ink controlling element. The way the operator moves the light pen over the display panel is generally in the form of a curve corresponding to the required ink film thickness profile. This ink film thickness profile indicates the ink quantities in the individual ink zones. It is, therefore, unnecessary for the operator to apply the light pen repeatedly to specific points on the display panel, and then remove the light pen from the point and reapply it to a new point. It is readily apparent, however, that the adjustment procedure can also be performed by applying the light pen to predetermined points of the display panel. Regarding the maximum speed at which the operator may pass the light pen along the display panel, reference is made to the more detailed description hereinafter.

Although the invention is explained mainly in conjunction with the process of entering values for adjusting the ink-control elements for the ink film thickness profile, it is an added object of the invention to provide such a method and device which further permits the entry of other data, for example for adjusting the registers of a printing machine by means of which it is possible to precisely match the images of different ink colors. Moreover, it is possible to enter control commands by means of the light pen.

SUMMARY

With the foregoing and other objects in view, there is provided, in accordance with the invention, a control device for entering and displaying control data for a printing machine having means for receiving control information consisting of at least one of the categories: data, control commands and changes therein and data for effecting a parameter change in response to information relating to the printed material being processed in the printing machine. The control device comprises a light pen and a control panel which is cooperatively associated with the light pen for entering the information.

In accordance with another feature of the invention, there is provided information data receiving means and means for effecting a machine parameter change, which may include changing the positions of a plurality of servomotors in an offset printing machine for the purpose of adjusting inkcontrolling elements for the ink film thickness profile and/or the dampening medium and adjustment of the registers in the printing machine.

In accordance with a further feature of the invention, the point of the light pen has a light receiver which cooperates with light-emitting elements disposed in the display panel. In accordance with an additional feature of the invention, these light-emitting elements are formed by the screen of a television picture tube or of some other type of cathode ray tube.

In accordance with yet another feature of the invention, the light-sensitive elements (photodiodes) and light-emitting elements (light-emitting diodes) are arranged in the form of a corresponding matrix of rows and columns of diodes, wherein each ink or dampening fluid-control element is assigned to a column of diodes. This arrangement was referred to hereinabove in the embodiment using light-emitting diodes. Each column of diodes, which in this embodiment of the invention is assigned to a specific ink or dampening fluid-control element, contains a certain number of diodes, for example sixteen diodes. In the case of a matrix formed of photodiodes, it is assumed that each matrix crosspoint also includes a light-emitting diode positioned closely to each corresponding photodiode, for the purpose of providing a visual indication. The individual dual parallel columns of diodes in the display panel are spaced apart at suitable intervals so that the position of all of the ink or dampening fluid-control elements is clearly visible when the light emitting diodes in the display panel are lighted.

In accordance with still a further feature of the invention, the light pen is a conventional device which provides detection of light contrasts and is cooperatively associated with a display panel containing liquid crystal elements.

The generally applicable operating mode of the invention is as follows: In order to enter each individual control element position value, the printing operator must move the light pen to a desired point in the column of diodes assigned to the corresponding controlling element (or, expressed in more general terms, he must move the light pen to the appropriate point in the display panel). In this connection, the operator may pass the light pen from the left-hand to the right-hand or from the right-hand to the left-hand side along the entire display panel, or he may merely cover part of the length of the display panel, or he may apply the light pen only at one or at only a few desired points.

In certain cases, however, it may be of advantage to have a different operating mode which, in accordance with another feature of the invention, may be selected and calls for the entry of a single value at a selected point on the display panel for one of the ink-control elements, that value being used as the position value for a predetermined group of the ink-control elements bordering on or adjacent said point. In accordance with a further feature of the invention, the selected group of ink-control elements includes all those ink-control elements which, in the matrix or display panel, are located on a selected side, for example the right-hand side of that row of elements into which a value was entered by the light pen. In the embodiment just described, the operator can, therefore, for example, if he wishes to enter the same value for all of the ink-controlling elements, merely enter that value at the appropriate point on the display panel which is farthest to the left-hand side, and that value will automatically be applied to all the ink-control elements from that point to the right-hand side on the display panel. The above described embodiment of the invention is particularly suitable for the rapid insertion of a stepped ink or dampening fluid film thickness profile, therefore referred to hereinafter as "stepped profile mode", whereas the first-mentioned operating mode is termed "profile mode".

The selected group of ink-control elements which are set to the same value as the ones which are individually activated by the operator may alternatively be selected differently. In this case the group may include two or three ink-control elements positioned to both sides or one side of the individually activated ink-control element, or it may include all elements to the left-hand side of the activated ink-control element, or it may include all the ink-control elements. Some or all of these various possibilities are selectable by the operator in accordance with aforesaid embodiment of the invention.

If a cathode ray tube or a television picture tube is provided as the display panel, interaction with a light-sensitive light pen can take place in the manner well known from computers, wherein the screen is scanned line by line by the electron beam and, as a result thereof, at those places at which there is to be no separate pictorial representation, the electron beam causes only a very slight screen brightness which nevertheless is sufficient to cause the light receiver in the light pen to respond. The time at which the light pen receives light from the beam is used to compute in conventional manner, the point on the screen at which the light pen is applied, and that information is then entered into a corresponding location of a memory. If the information is to be displayed on the screen, it can be generated by applying a higher current value of the electron beam, as is well known and used in television engineering.

In comparison, in accordance with still another embodiment of the invention the display panel contains a matrix of light-emitting diodes which, in addition to cooperating with the light pen, also serve for visual indication purposes, the light-emitting diodes are energized in a predetermined order by current pulses so that those light-emitting diodes which are not intended to give a visual indication are energized with such a short current pulse that they, to the human eye, do not appear to illuminate or merely appear to illuminate only weakly, whereas those light-emitting diodes which are intended to give a visual indication are energized with a relatively long current pulse which, to the human eye, makes them appear to illuminate brightly.

In the latter case, the light pen is effective only during the times it receives the short pulses. A particular advantage of this feature is that purely digital control of the diodes is possible since the brightness is controlled merely by means of the time duration of the current flowing through the diodes, with the current value for all diodes during current flow can remain the same. Those diodes which have to present a visual indication are in this way operated in time division multiplex and, during those times in which they present the display, they are not activating the light pen. This embodiment can be realized in a particularly simple manner because the sixteen diodes, for example of one column which are assigned to a given ink-control element, can be energized sequentially with short pulses, and since the position in time of these pulses is fixed, they permit the light pen to identify which diode is lit and, following this period wherein each of the sixteen diodes has been briefly energized with current, there is a longer period wherein any one of the diodes which represent a visual indication is energized with a current pulse of longer duration in order to present a stronger light. The fact determining which of the diodes light up in this period depends merely upon the respective actual position of the ink-control element assigned to the respective column. It is readily apparent that the display panel can also be used for indicating other information, for example for indicating the desired values entered by the light pen, or merely for acknowledging that the light pen has entered an item of information in a corresponding column of the display panel. To distinguish the desired values from the actual values, the desired value displays can be made identifiable by an illumination mode which is different from that for the actual-value indication, for example by flashing light instead of steady light. It is also possible, in accordance with the invention, to provide each column with separate light-emitting diodes which serve simply for showing the desired values.

The speed with which an operator is able to pass the light pen over the display panel is limited by the number of light-emitting diodes in the entire display panel and the clock frequency with which the light-emitting diodes are caused to light up briefly in sequence in order to identify their position to the light pen, and is also as a function of the area covered by the light pen, and more precisely stated, the diameter of that area. For the value of speed described for the embodiment described in more detail hereinbelow, the maximum speed of the light pen for a coarse indication operating mode is 60 cm/s. The permissible speed of the light pen can be further increased in a further development of the invention. In accordance with yet a further embodiment of the invention, two energizing cycles are provided for the light elements in order to reduce the scanning time for the display; in a first energizing cycle, all of the light elements are energized in a predetermined order at a given pulse repetition rate with short pulses just for light pen operation, and such that, after a value has been entered by the light pen at any desired point on the matrix, a second energizing cycle is started which, with short pulses and at the same pulse repetition rate, energizes only part of the elements in the area surrounding the point at which the value was entered. During the first energizing cycle, it is reliably recognized that the operator is applying the light pen to some point on the display panel. There is then a changeover the second energizing cycle, and then it is no longer the entire display panel which is energized, but only the part of the display panel surrounding the place where the light pen was just applied, and the individual columns of the matrix of the display panel in this area can therefore be energized more frequently in sequence and, thus, the light pen can be moved more quickly in this energized area than in the first energizing cycle. The area of the display panel energized in the second energizing cycle moves with the light pen as the latter is moved. If, during a predetermined time period, no further information is fed into the device through the light pen, the device concludes from this that the printer has again removed the light pen from the display panel, and switches back again to the first energizing cycle.

In accordance with still another mode of the invention, there is provided a device having means for receiving information formed of at least one of the categories: data, commands and changes therein and means for effecting a parameter change in response to the received information with respect to the material being printed in the printing machine, including entering the information with a light pen into the printing machine by placing the light pen point focusing on a part of a control panel having at least some optical elements selected from the categories consisting of light emitting and/or light sensing opto-electronic elements, corresponding with the type of optical element in the point of the light pen for receiving information therefrom, sending information for effecting parameter change.

In accordance with a further mode of the invention, there is provided a method of entering and displaying data for controlling a printing machine with a device having means for receiving information formed of at least one of the categories of data, commands and changes therein and means for effecting a parameter change in response to the received information with respect to the material being printed in the printing machine, which comprises introducing the information with a light pen into the printing machine by moving the light pen over a control panel having at least some optical elements of the categories selected from the group consisting of light emitting and light sensing opto-electronic elements corresponding with the optical element in the light pen for receiving transfer of the information therefrom, and applying the information to the means for effecting the parameter change.

In accordance with an additional mode of the invention, a light pen can be moved along the operating control panel in any one of a rectilinear, stepwise and curved manner.

In accordance with an added mode of the invention, the information receiving means and the means for effecting a parameter change comprise a plurality of servomotors in an offset printing machine for adjusting ink-controlling elements for at least one of the film thickness profile of ink and dampening medium and adjustment of the position registers in the offset printing machine, and which includes introducing a given value of the information at a selected point on the control panel for adjusting to a given value at least one of the servomotors, associated directly with the columns, to the given value.

In accordance with yet another mode of the invention, the method comprises adjusting the respective servomotor directly and automatically after the information is introduced into the operator control panel.

In accordance with yet a further feature of the invention, the method includes adjusting the respective servomotor directly and automatically after a manual instruction has been introduced into the operator control panel.

In accordance with still a further feature of the invention, the method includes indicating the information introduced into the operator control panel, storing the information in a memory and recalling the information from the memory for adjusting the respective servomotor and performing the commands, respectively.

Other features which are considered as characteristic for the invention are set forth in the appended claims.

Although the invention is illustrated and described herein as embodied in a method and device for controlling a printing machine, it is nevertheless not intended to be limited to the details shown since various modifications and structural changes may be made therein without departing from the spirit of the invention and within the scope and range of equivalents of the claims.

BRIEF DESCRIPTION OF THE DRAWINGS

The construction and method of operation of the invention, however, together with additional objects and advantages thereof will be best understood from the following description of specific embodiments when read in connection with the accompanying drawings, in which:

FIGS. 10*a* and 10*b* show the control logic according to FIG. 4 for the data entry and display device with all input and output leads in FIG. 10*a* and the Boolean equations that govern the relationship between inputs and outputs in FIG. 10*b*.

DETAILED DESCRIPTION OF THE PREFERRED EMBODIMENTS

Figure 1:
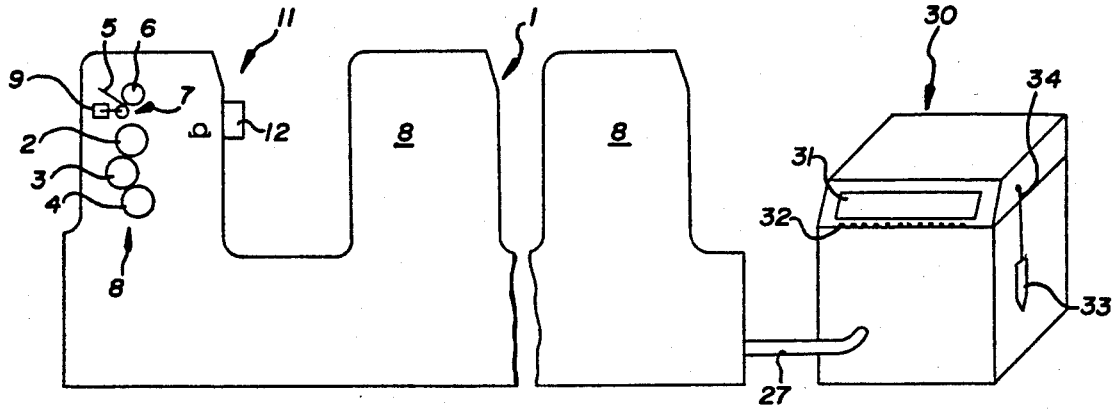
FIG. 1 is a simplified diagrammatic elevational view of a printing machine, and a data entry and display device according to the printing machine.

Referring now to the drawing and, first, particularly, to FIG. 1 thereof, there is shown in a partly broken-away side elevational view, an offset printing machine 1 with five printing units 8, two of which have been omitted. Shown in the left-hand printing unit are some of the machine parts and components of a printing unit 8. The printing unit has a plate cylinder 2, on the circumference of which is carried a printing plate, and which cooperates with a rubber-covered offset cylinder 3 which transfers printing ink onto paper being printed passing between the offset cylinder 3 and an impression cylinder 4. Also the ink metering duct 5 with the ductor cylinder 6 of the respective inking unit is visible, in this figure.

Figure 2:
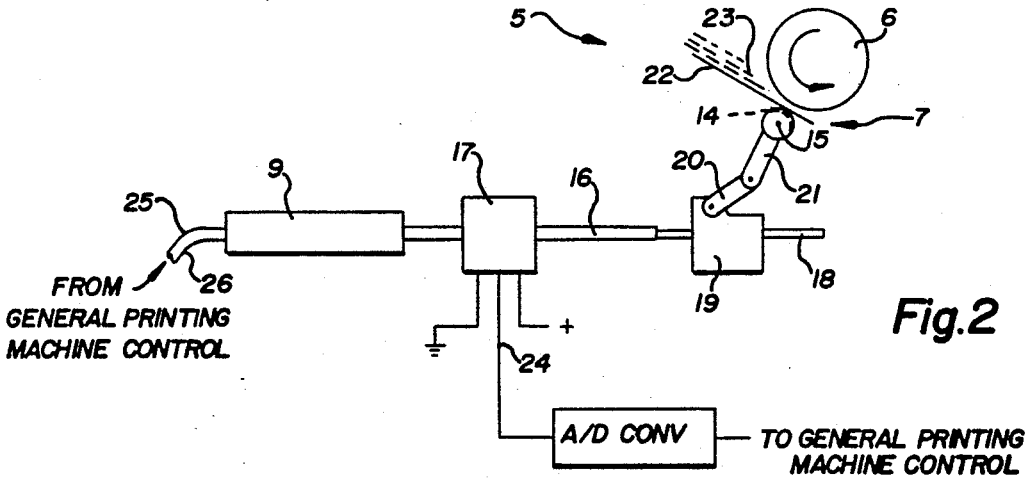
FIG. 2 is an enlarged fragmentary view of FIG. 1 showing diagrammatically a servomotor coupled to an ink cylinder forming part of the printing machine.

Located on the lower region of the ink metering duct 5 is a multi-section ink blade 7 formed of a series of ink cylinders 15, seen in more detail in FIG. 2. Each of the ink cylinders 15 is connected to a servomotor 9. A dampening unit is associated with the printing unit 8 and has a water tank 12. Numerous other devices, especially rollers for transporting the printing ink and the water, as well as transfer rollers, are not shown in the interest of clarity.

FIG. 2 also shows in simplified form the adjusting mechanism for one of the ink cylinders 15 of the multi-section ink blade 7. The servomotor 9 is advantageously a direct-current motor which drives a shaft 16 to which a potentiometer 17 is coupled. The shaft 16 has an extended threaded section 18 which engages an adjusting part 19 with a matching threaded hole for receiving the threaded section 18 and which is connected via a link 20 to a lever 21 which is rigidly connected to the ink cylinder 15. The bottom of the ink metering duct 5 is formed by a foil 22 of plastic material and, depending upon the position of the ink cylinder 15, which has an eccentric portion 14, this plastic-material foil 22 may be moved toward the outer surface of the ductor 6 leaving a greater or lesser gap 23 through which the ink can reach the lower region of the ductor roller 6. The ink is then passed to further, non-illustrated rollers of the inking unit. The ink cylinder 15 is thus adjusted by the displacement of the adjusting part 19 as a result of rotary movement of the servomotor 9. Two of the electric leads of the potentiometer 17 extends to a power supply supplying+and ground potential; the slider of the potentiometer is brought out via a third lead 24. The potentiometer 17 thus makes it possible to measure accurately the respective position of the ink cylinder 15. Thirty-two ink cylinders 15 are typically assigned to each of the printing units 8 of the printing machine. The electric leads 25 and 26 of all the servomotors 9 and the leads 24 of all the potentiometers 17 extend via a cable 27 (FIG. 1) to a data entry and display desk 30 having a display panel 31 equipped with light-emitting diodes. The actual positions of the ink cylinders 15 of each of the individual printing units can be displayed selectively upon the display panel 31 by means of an array of light-emitting diodes. The control desk 30 has a light pen 33 which is connected to the control desk 30 via a connecting lead 34. The light pen 33 has a light-sensitive element, for example a photo-transistor in the tip of the light pen. The light pen 33, which has approximately the size and shape of a ballpoint pen, can be moved by hand over the display panel 31 in order to introduce data into the control desk 30. Moreover, the control desk 30 features a keyboard 32 containing a multiplicity of keys for the data entry.

Figure 3:
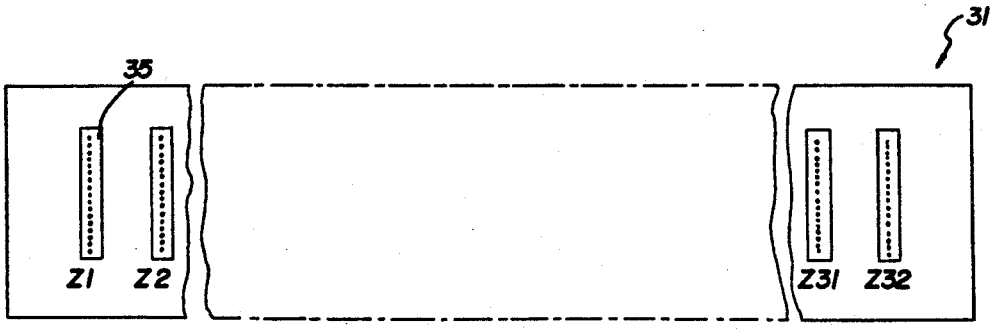
FIG. 3 is an enlarged fragmentary view of FIG. 1 showing a display panel of the control device of the invention equipped with optical elements.

FIG. 3 shows the display panel 31 separately. In the illustrated embodiment, the display panel 31 contains typically thirty-two columns, each having sixteen light-emitting diodes 35. The individual columns Z1–Z32, of which only four are shown in FIG. 3 because of the fragmentary representation, are identified as Z1, Z2, . . . up to Z31, Z32, thus presenting a total of thirty-two ink cylinders and thirty-two inking zones of a printing unit.

There are two different modes of indicating the position of the ink cylinders 15 of one of the printing units of the printing machine 1, selected by means of the keyboard 32. In a coarse display mode, one diode lights up brightly in each column 2 of light-emitting diodes 35 so that, in this way, sixteen different positions of each of the respective ink cylinders 15 can be read on the display panel 31. In a fine display mode, the adjustment range of the ink cylinders 15 is indicated by a differently illuminated light-emitting diode 35 of a column Z, which indicates one of sixteen additional fine steps between each of the coarse steps and each of these intermediate values is indicated by a contrastingly different, e.g. less brightly illuminated light-emitting diode 35 in the same column which lights up simultaneously with the brightly illuminated diode indicating the coarse value. In this way, it is possible, in the fine display mode, to indicate a total of $16 \times 16 = 256$ different positions for each ink cylinder 15. Since each ink cylinder 15 is assigned to an inking zone, the columns of light-emitting diodes 35 are also referenced hereinafter as "ink zones" or simply "zones".

Figure 4:
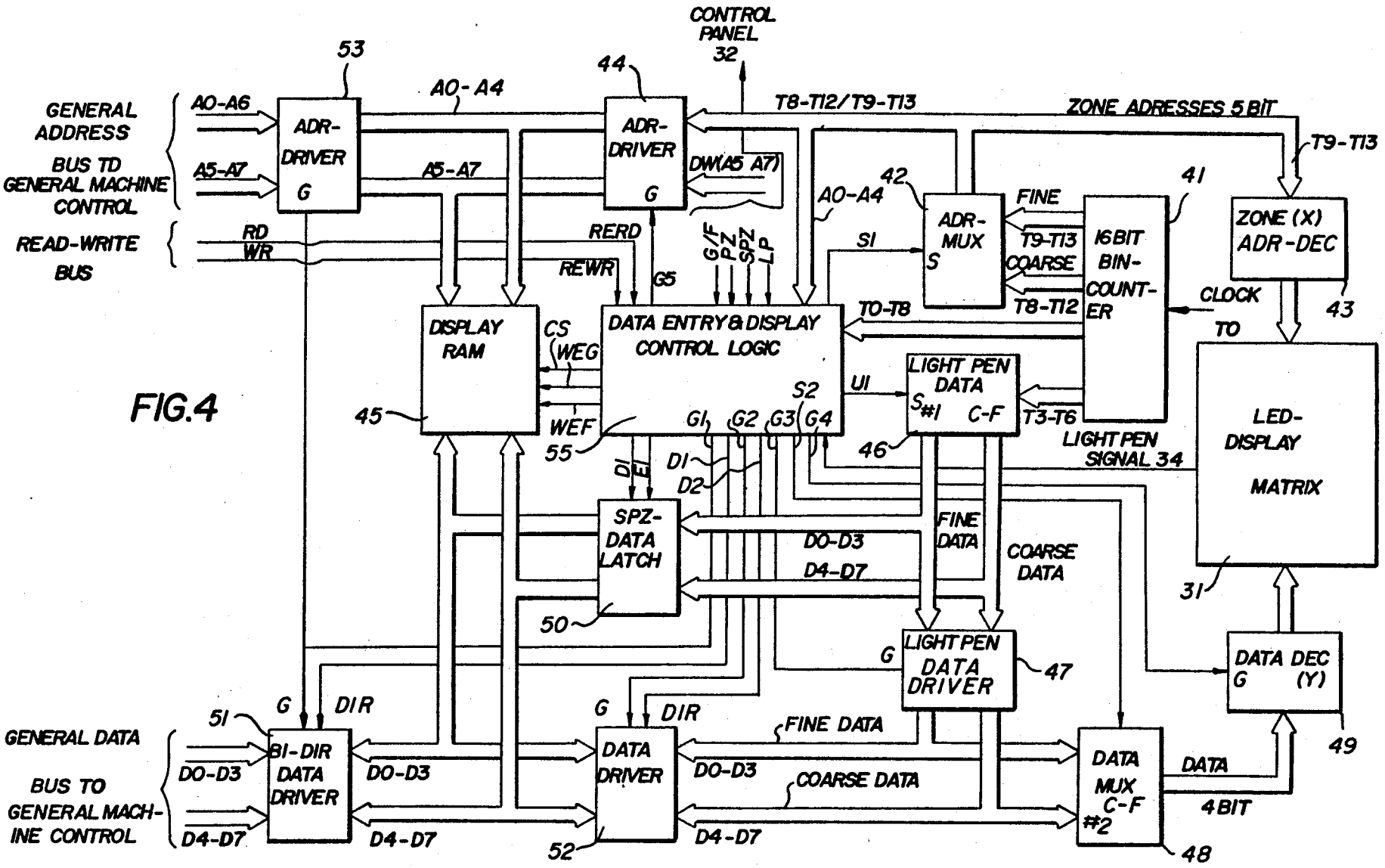
FIG. 4 is a basic block diagram of the electronic circuit for the invention.

The block diagram FIG. 4 shows the building blocks of the data entry and display control circuit that operate to display the position of the ink cylinders 14 of FIG. 2 on the display panel 31 and to receive the instructions for modifying those positions in response to the machine operator's manipulation of the light pen 33 in conjunction with the display panel 31.

It is to be understood that the printing machine also feature other general control circuits that serve, for example, to preset the machine's control elements, and for monitoring the proper operation of the machine. The instant invention has an electronic data entry and display control 55, which is separate from aforesaid general control circuit, but is interfacing therewith. The electronic circuit of the instant invention serves for entering and displaying data by means of a light pen, and in turn for interacting with the general control.

The circuit shown in FIG. 4 operates in conjunction with the general control circuits connected to the left hand side of the circuit via a general address bus and a bi-directional data bus designated as such in the FIG. 4. The general control, is at all times monitoring the positions of all the ink cylinders 15 by means of the position indication analog signal furnished by each of the potentiometers 17 via the potentiometer slide contact lead 24 and via an analog-to-digital converter 14*a* shown in FIG. 2.

The general control, which is not shown since it is conventional and is not part of the instant invention, has stored in its data memory the positions of all the ink cylinders 14. The general control also has the capability to control the servomotors 9 by applying a control signal to the input leads 25–26 to the motor. The motor is a direct-current motor that can rotate in either direction depending upon the polarity of a direct-current signal applied to the leads 25–26. The non-illustrated general control operates in parallel with data entry and display of the control circuit of FIG. 4 and is connected thereto by a bi-directional general data bus having data leads D0–D3 and D4–D7 and a general address bus consisting of address leads A0–A4 and A5–A7. The address bus is connected to an address driver 53 and the data D0–D3 and D4–D7 are connected to a bi-directional data driver 51.

The data entry and display control circuit of FIG. 4 may operate in one of the following five modes:

1. The general control writes position data in preparation for entering a new printing job into the Display RAM 45 via the general address bus A0–A7 and the general data bus D0–D7;
2. The data present in the display RAM 45, e.g. presetting data for the ink cylinders 15, are read into the general control;
3. The contents of the display RAM 45 are displayed as coarse-fine data on the display panel 31;
4. An optional profile for coarse and fine data is entered by means of the light pen;
5. A step profile for coarse and fine data is entered by means of the light pen.

In the following description, the term data indicate ink cylinder position data which are correlated with ink zone addresses, which are displayed on the display panel 31 on the thirty-two columns, each with sixteen light-emitting diodes 35.

Also, in the following description of the operation of the data entry and display control, reference is made to the block diagram of FIG. 4 and to the schematic circuit diagram of the data entry and control logic 55, seen in more detail in FIG. 11.

In mode No. 1 the general control enters via the address driver 53 and the data driver 51 position data for the positions of the ink cylinders 15 into the display RAM 45.

The control lead REWR causes the control logic to generate the signals CS, WEG, WEF and G1. By means of these signals the data supplied by the control logic are stored under the just filed address. During computer i.e. general control access the building blocks 44, 50 and 52 are always highly resistive, i.e. disabled. In the mode 2, the general control accesses the display RAM 45 via address driver 53 and via data driver 51. The transfer of data from the display RAM 45 to the general control is controlled by the control lines RERD, CS, G1 and D1 from the data entry and display control logic 55.

In the mode 3, there is distinction between the coarse and the fine display, controlled by the control line G/F to the control logic 55 of the keyboard 32 (FIG. 1).

In this mode, the addresses for the display RAM 45 are generated by a sixteen-stage binary address counter 41, driven by a clock input TO. The clock frequency TO is divided $2^{16}$. The counter 41 consists of sixteen divider stages T0–T15, T14–T15 not being used for the light pen.

The stages T8–T12 form the thirty-two five bit addresses that continuously scan the thirty-two zones of the display matrix 31, one at a time in sequence.

Coarse Display Mode

Figure 5A:
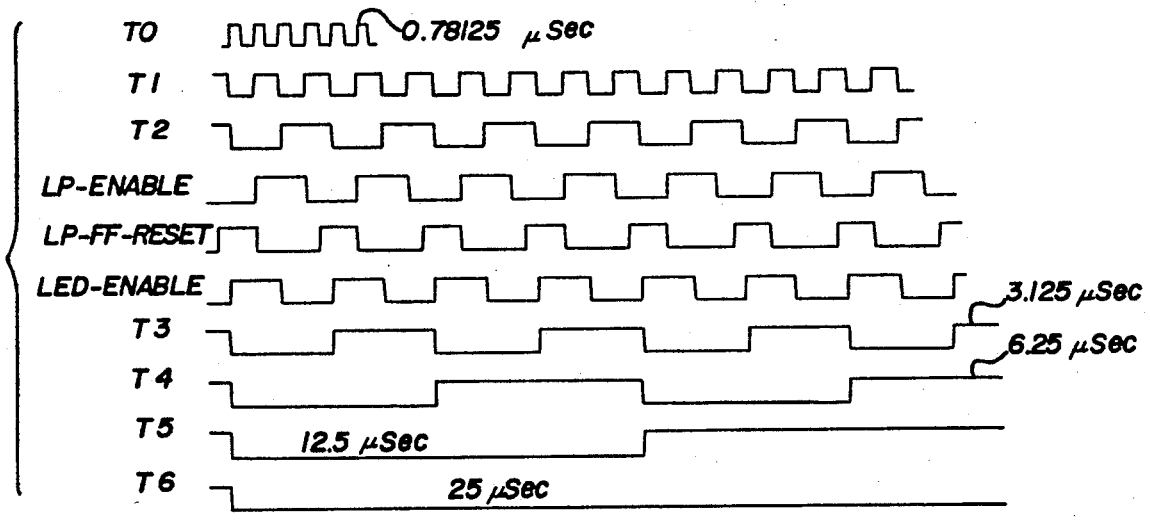
FIG. 5*a* is a timing diagram for the electronic circuit, which forms part of the invention, showing the higher frequency clock pulses.
Figure 5B:
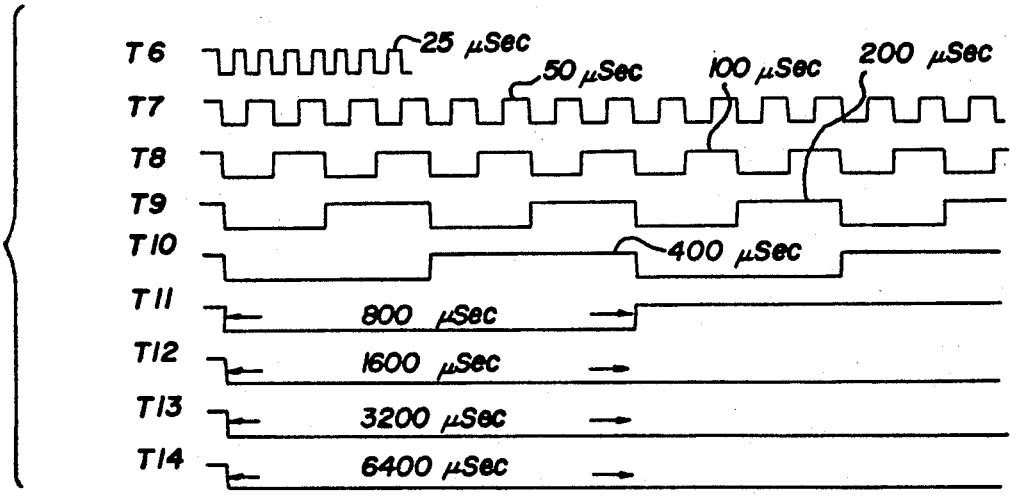
FIG. 5*b* is a timing diagram for the electronic circuit, which forms part of the invention, showing the lower frequency clock pulses.

In the coarse display mode these thirty-two address signals each have a duration of 100 microseconds as seen in FIG. 5*b* which is the duration of the timing pulses T8.

The thirty-two zone addresses are connected to the LED display matrix 31 via the address multiplexer 42 during the time that the lead S1 of the control logic 55 is low. Via the zone address decoder 43 the binary signals T8–T12 are decoded into thirty-two discrete individual zone addresses.

The thirty-two zone addresses T8–T12 are connected under control of the control signal G5 from the control logic 55 through the address driver 44 as address leads A0–A4 to the display RAM 45. Each of the 100 microsecond address pulses are divided into a 50 microsecond light pen time and a 50 microsecond coarse display time. In case there is not a light pen mode present, there is no data flow to the LED display matrix 31 during the LG time, since during this time the LED display matrix 31 is not switched on under control of the control lead G4 of the control logic 55, the control lead G4 switching off the decoder 49.

During the time the coarse display indication is on, the addressed data from the display RAM 45 are switched through the data driver 52 to the data multiplexer 48 under control of the control lead G2 from the control logic 55. During that time the light pen data driver 47 is inhibited under control of the control lead G3 from the control logic 55. Since the coarse data are switched on and selected, the coarse data are switched to the LED matrix 31 through the data decoder 49 under control of the control lead G4 from the control logic 55, while simultaneously the control lead S2 is low.

After the elapse of each coarse display time the zone address is incremented by one until zone "32" is displayed and the scan is repeated, starting with zone "1".

Fine Display Mode

The fine display when selected is activated as follows:

The zone addresses are scanned by timing pulses T9–T13 from the counter 41, and appear as 200 microsecond pulses, seen as T9 in FIG. 5*b*. These 200 microseconds are divided into 50 microseconds for the light pen, 50 microseconds for the fine display time and 100 microseconds for the coarse display time. Thereby, the fine display shows a lower display intensity than the coarse display due to its shorter duration of activation. During the light pen time the display is disabled. During the fine display time the fine data of the display RAM 45 are switched via the data driver 52 and the data bus (fine data) to the data multiplexer 48 which is activated by the control lead S2 of the control logic 55. Via the data decoder 49 these data are passed to the LED matrix 31 under control of the control lead G4.

After the elapse of the following coarse display time of 100 microseconds the process is repeated at the next zone address.

Profile Plotting Mode

In mode 4, the profile of the ink distribution is written by means of the light pen across the LED matrix 31. This operating mode is activated via the control lead PZ to the control logic 55.

The profile plotting mode is divided into a coarse profile mode and a fine profile plotting mode. The respectively desired mode is activated by the control lead G/F via input in the keyboard 32. The successive switching-on of the zone addresses is performed in this mode exactly as described in connection with the description of mode 3. The only difference resides in the data flow during the light pen time (LG-time).

Coarse Profile Plotting Mode

During the input or the plotting of the coarse profile the timing pulses T3–T6 from the counter 41 are switched to the light pen multiplexer G-F 46 and then under control of the control lead U1 of the control logic 55, which is low at this time, to the light pen data driver 47.

In addition to the entered coarse data, the data value of the ninth light-emitting diode, which is generated in light pen data multiplexer 46, is switched to the light pen data driver 47 as a fine value. From this data driver 47 the coarse and fine data are switched to the data driver 52 under the control of the control lead G3 from the control logic 55 The data driver 52 switches these data to the display RAM 45 under control of the control lead D2, G2 of the control logic 55.

The same data are present at the data multiplexer 48 Since the coarse profile mode is selected, only the coarse data due to the signal S2 being low, are switched from the data multiplexer 48 via the data decoder 49 to the LED display matrix 31 under control of the lead G4.

During the LG time each of the sixteen light-emitting diodes of the zone addresses is controlled sequentially within approximately 3.2 μsec for a period of approximately 1.6 μs (LED-Enable) by means of these data.

In case the light pen is held with its tip pointed at one of these light-emitting diodes, the photo-diode in the light pen detects the presence of this short light pulse, and consequently the control logic 55 receives a light pen pulse LP through the light pen cord 34. As a of this light pen pulse the control signal CS, WEG and WEF are switched to the display RAM 45 which stores the value of the T3–T6 bus as a new data value at the moment the light pen pulse LP was detected and which corresponds to the light-emitting diode to which the light pen was pointed. This new value is displayed as a new coarse value for the following mode 3. At the same time the ninth light-emitting diode in the selected zone is stored as a fine value in the display RAM 45. Thus in the case of a fine adjustment to be performed later on, there is the possibility of adjusting a respective ink cylinder both in positive or negative direction.

After the LG-time, the coarse display time is automatically selected as described in mode 3.

Fine Profile Plotting Mode

For plotting the fine data the clock pulses T3–T6 are switched from the counter 41 via the light pen data multiplexer 46 as light pen fine data and light pen coarse data and via the light pen data driver 47 and via the data driver 52 to the display RAM 45 and also to the data multiplexer 48.

In this fine profile plotting mode the coarse data are without significance, since for these there is no write signal WEG being generated by the control logic 55. As the light pen coarse data and light pen fine data are the same, the light pen coarse data are transmitted to the display matrix 31 under control of the lead S2 being low, via the data multiplexer 48 and via the activated data decoder 49. In case the light pen 33 receives an pulse from a selected light-emitting diode via the cord 34, the control logic 55 sends only the write signals CS and WEF to the display RAM 45. In this case only the fine data are transmitted to-the display RAM 45.

After the elapse of the LG-time, as in mode 3, follows the fine display time and then the coarse display time.

Step Profile Plotting Mode

Mode 5, in which a coarse and fine step profile is written, is selected from the control panel 32 via the lead SPZ to the control logic 55. The time sequence for indicating the coarse and the fine profile, as well as the generation of the data and the data flow to the LED display matrix 31 take place as described under mode 4.

In this case, the data flow to the display RAM 45 runs via the SPZ data latch 50 selected by means of the signals 01 and E1, the data driver 52 being highly resistive. If the light pen recognizes a selected light-emitting diode during the light pen time, the control logic 55 sets by means of the lead 34 the SPZ flip-flop, which disables the inputs of the SPZ data latch 50 by means of the signal E1. The instant data are stored and are present at the display RAM 45. If the sixteenth light-emitting diode in the LED display matrix 31 is selected by means of the data, the control logic generates by means of the data, the clock pulses T3–T6 the write signals CS, WEG, WEF for coarse plotting or CS, WEF for fine plotting. After the elapse of the light pen time the data buffered in the SPZ data latch 50 are transmitted to the display RAM 45. The SPZ flip-flop is only reset at the end of the light pen time of the last address. After the elapse of the light pen time the output of the SPZ data latch 50 is disabled by the non-active signal 01 and the display times are as described in mode 3. Thereafter the binary counter 41 increments the address and a new light pen time begins. Even if the light pen does not recognize an illuminating light-emitting diode under the subsequent address, the value still stored in the SPZ data latch 50 after the elapse of the light pen time is transmitted to the display RAM 45 and stored under the newly filed address. This way the same data value is stored in all addresses up to address "32". After elapse of the light pen time of address "32" the SPZ flip-flop is reset and the data input of the SPZ data latch 50 is enabled to receive a new value.

Figure 8:
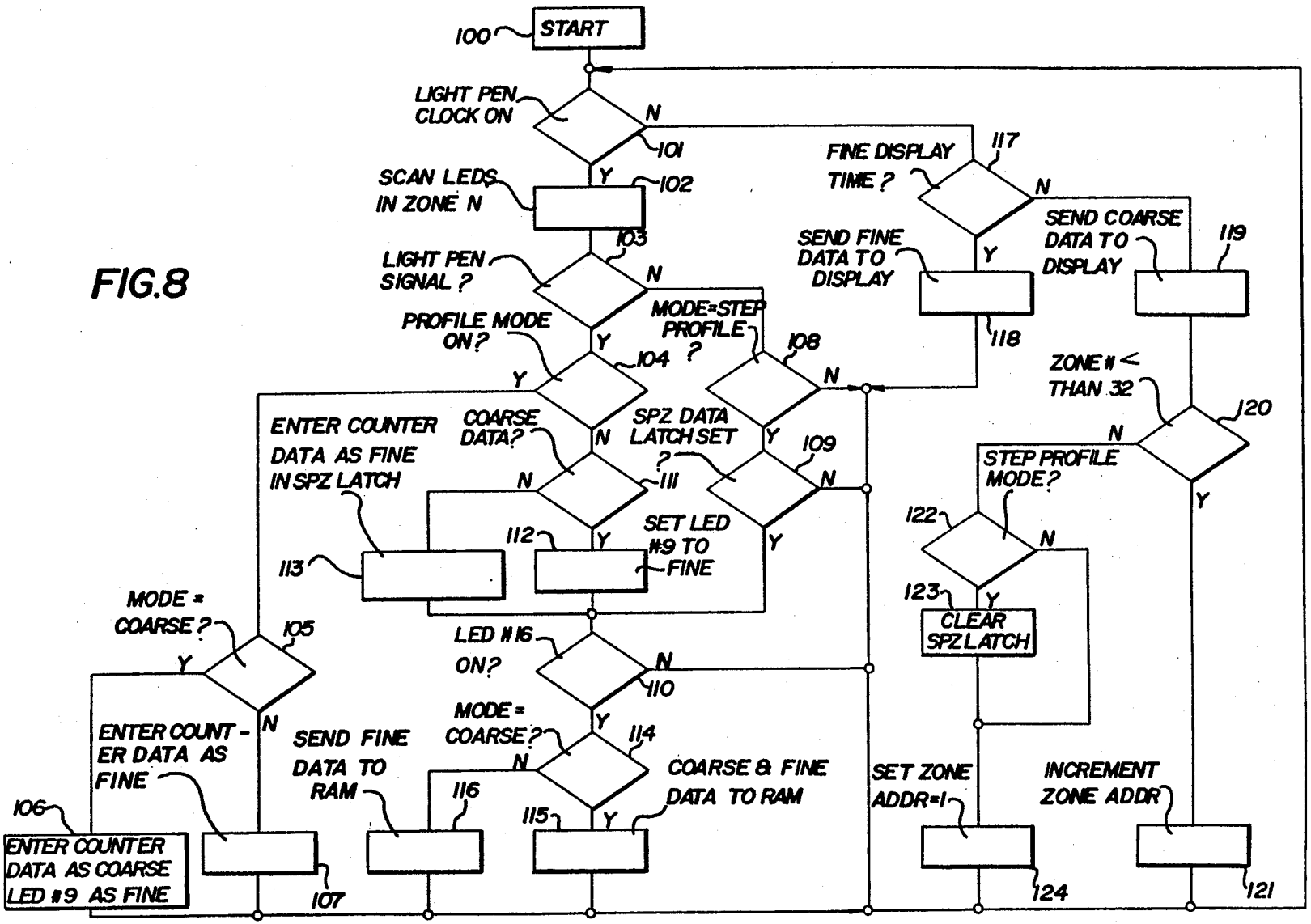
FIG. 8 is a flow chart showing step by step the operation of the invention.

Having now described the five operating modes of the invention, the operation will be described step-by-step in reference to the flow chart (FIG. 8). The control logic generates, as shown in FIG. 4, in sequence:

(1) light pen time,
(2) fine display time,
(3) coarse display time.

The steps selected after steps 101 or 117, following start 100, depend on the just elapsed time (1), (2) or (3). After the start of the light pen time the sixteen light-emitting diodes of zone n are sequentially selected in step 102, provided that the light pen time has been activated (decision 101). If during the light pen time, the light pen received a signal from one of these light-emitting diodes (decision 103), the further process depends on the decision as to whether the operator selects "profile plotting" or "step profile plotting" (decision 104). If, during the light pen time, the light pen did not receive a signal from one light-emitting diode (decision 103), decision 110 is directly selected, provided that the mode "step profile plotting" (decision 108) has been selected and the SPZ flip-flop (decision 109) has been set. If one of these conditions has not been met, decision 101 is selected.

If the mode "profile plotting" (decision 104) together with the mode "coarse plotting" (decision 105) is selected, the counter data which are present at the display RAM 45 at the moment the light pen recognizes the signal are written as coarse data and the data value of the ninth light-emitting diode is written as a fine value in the display RAM 45 (step 106). If the mode "fine plotting" is selected, the counter data are written into the display RAM as fine data (step 107).

In case of the mode "coarse plotting" (decision 111), provided the "profile plotting mode" was not selected (decision 104), the counter data are stored as coarse data and the data value of the ninth light-emitting diode as fine value in the SPZ data latch 50 (step 112). In the same step the SPZ flip-flop is set. If the mode "fine profile plotting" is selected (decision 111), the counter data are stored as fine data in the SPZ data latch 50 in step 113. During the phase the sixteenth light-emitting diode of a zone is selected (decision 110) the coarse and fine data stored in the SPZ data latch 50 (step 115) are stored in the display RAM 45 if the mode "coarse plotting" is selected; if the mode "fine plotting" decision 114) is selected, only the fine data (step 116) are stored in the display RAM 45. If the sixteenth light emitting diode is not selected (decision 110), decision 101 is referred to.

After steps 115 and 116, respectively, decision 101 is also referred to. Since at this time the light pen time has elapsed, the fine data from the display RAM 45 (decision 118) are displayed, controlled by the control logic 55 until the fine display time has elapsed, if the operator has selected the fine display mode (decision 117).

Since until now the light pen time and the fine display time have elapsed, the control logic 55 sends the signal "coarse display time". The coarse display time is effected by the negation of both decisions 101 and 117. During this time, the coarse data are transmitted from the display RAM 45 to the display (step 119). After the elapse of this time the address value is incremented by one (step 121), if the address value for zone "32" has been reached, the address value is set to "1" (step 124), if the operator has selected the mode "profile plotting" (decision 122). If, however, the mode "step profile plotting" has been selected (decision 122), the SPZ data latch 50 is cleared, in step 123 so that it enables the stored counter data in steps 112 and 113. At the same time, the SPZ flip-flop is reset. Afterwards the address value is set to "1" (step 124).

The control logic 55 may advantageously be constructed as a state-variable machine which is a well known art, in which each output is determined as a result of a Boolean algebraic equation controlled by certain input conditions. The Boolean equations that control all the outputs are shown in FIG. 10, using conventional Boolean notation.

Figure 9A:
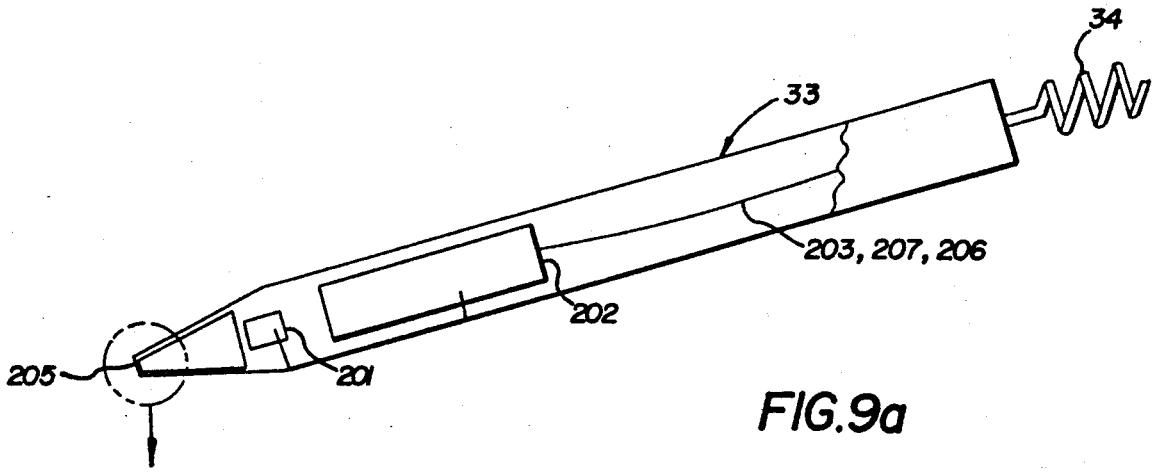
FIGS. 9*a*, 9*b* and 9*c* show a light pen, a light pen tip and circuitry, respectively.
Figure 9B:
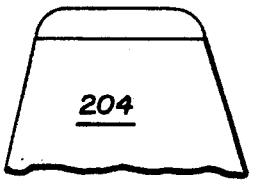

FIGS. 9*a, b* and *c* show details of a conventional light pen. FIG. 9*a* shows in cross-section the structure 33, with the cable 34 connecting it to the control desk 30, a mounting plate 202 supporting the small components, including the photo-diode 201 mounted behind a conical light conductor 203 in the tip 204 of the light pen. The end of the tip 204 is terminated in a scratch resistant quartz or sapphire lens 205, shown enlarged in FIG. 9*b*.

Figure 9C:
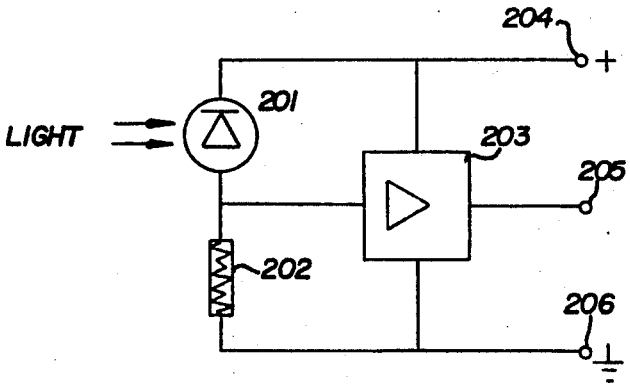

FIG. 9*c* shows a circuit diagram of the electrical components forming the light pen circuit, consisting of the photo diode 201, a bias resistor 202, an amplifier 203 having an output lead 205 and two power supply leads 204 and 206, supplying plus and ground potential, respectively.

It should be noted that although the light pen in the instant disclosure is used for entering ink adjustment data, it need not be limited to only such use. It can also be used to insert other types of operating data, such as machine operational data for control of registers, dampening fluid, machine speed, etc. by providing light-emitting diodes representing these parameters.

Figure 6:
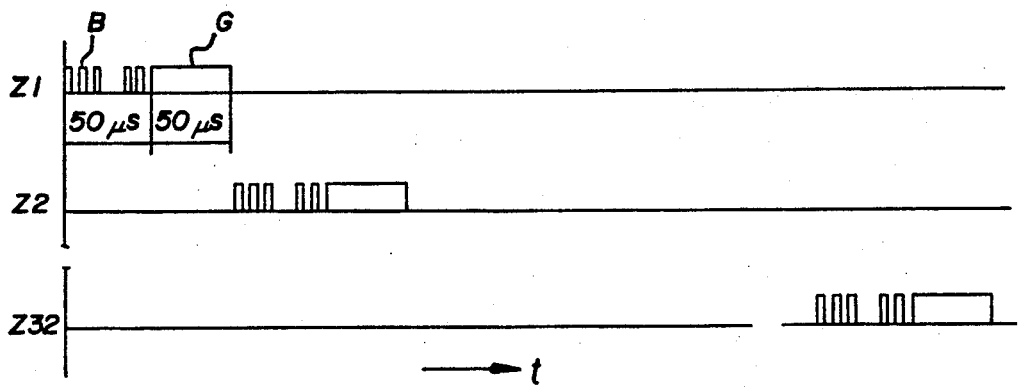
FIG. 6 is a timing diagram showing details of the clock pulses that control the coarse data of the LED matrix.
Figure 7:
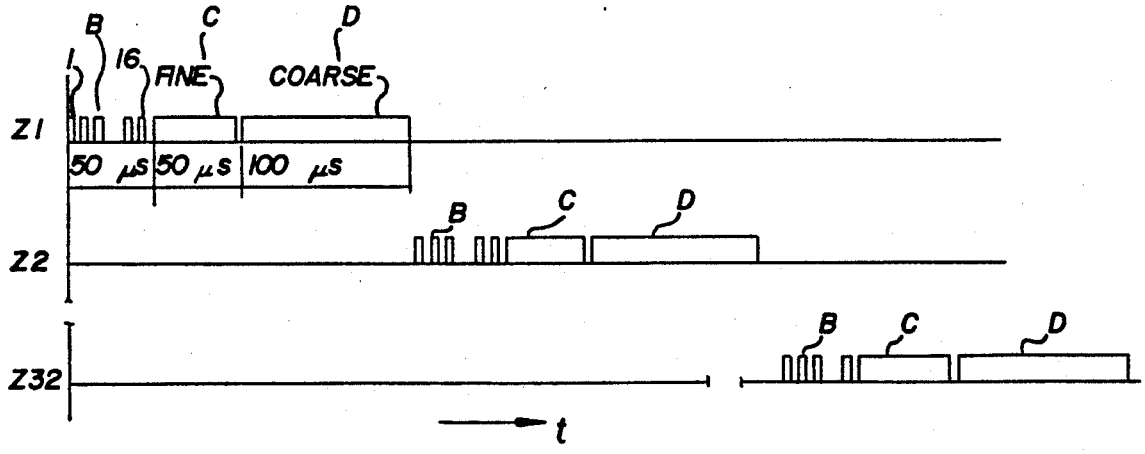
FIG. 7 is a timing diagram showing details of the clock pulses that control the fine and the coarse displays of the LED matrix.

FIGS. 6 and 7 show timing diagrams, in which FIG. 6 shows the scanning of the sixteen light-emitting diodes at B for zones Z1, Z2 and Z32 which take place as sixteen steps, with fifty microseconds guard time G separating transition from one zone to the next.

FIG. 7 is a similar timing diagram, but with the addition of fifty microseconds at C for the fine display and 100 microseconds for the entire coarse display at D.

Figure 11:
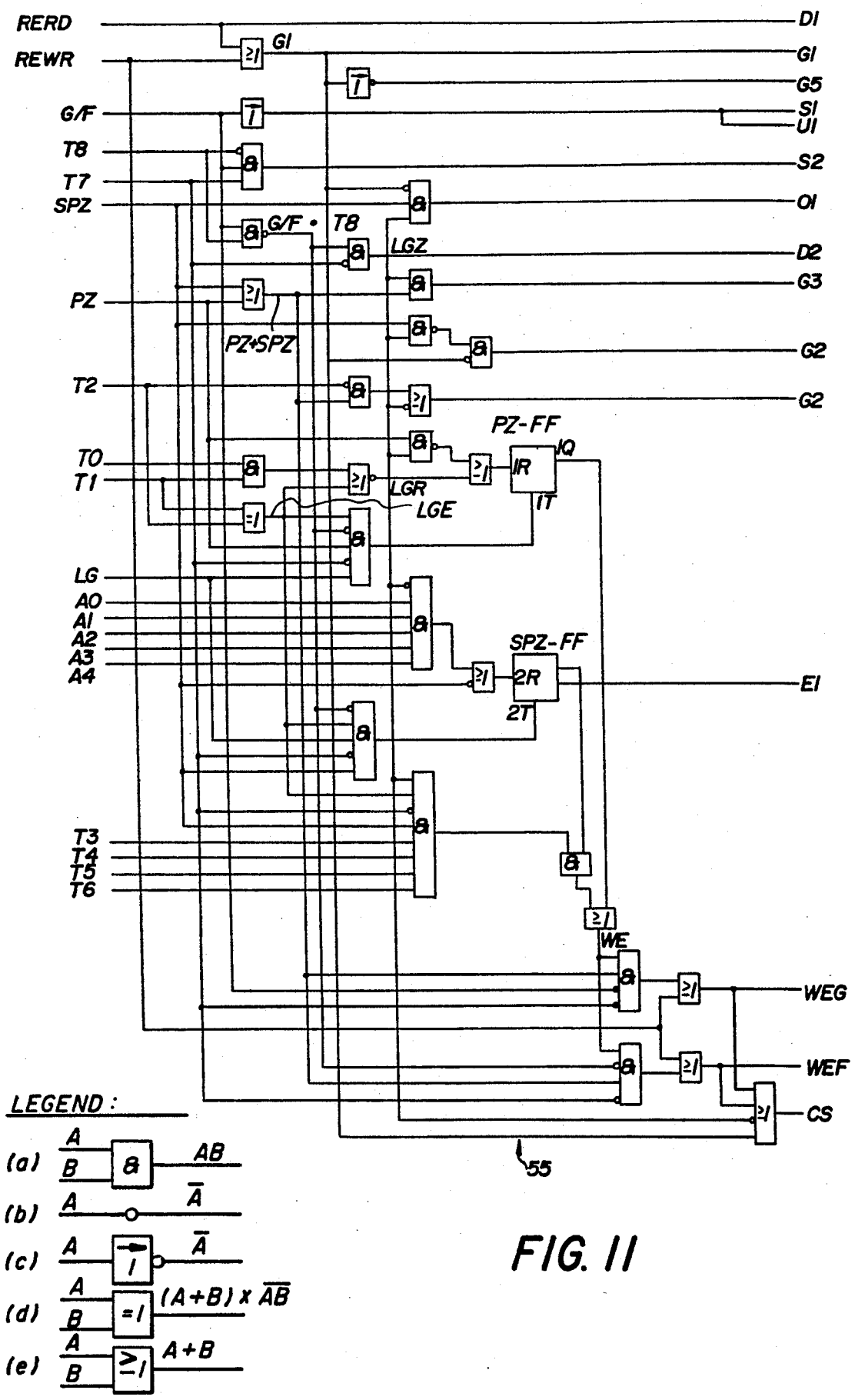
FIG. 11 is a schematic circuit diagram of the control logic for the data entry and display device in accordance with the Boolean equations shown in FIG. 10*b*.

FIG. 11 shows in schematic circuit diagram form the gates forming the components of the data entry and display logic 55.

The components are well known logic gates of various types as indicated by their labels. The logic definition of each gate is shown in the legend, wherein FIG. 11*a* is an AND-gate, FIG. 11*b* is a logic inversion, FIG. 11*c* is an inverter, FIG. 11*d* is an exclusive OR-gate and FIG. 11*e* is an OR-gate. The logic diagram of FIG. 11 corresponds to the Boolean equations shown for the data entry and display control logic shown in FIG. 10*b*.

We claim:

1. A printing machine comprising: a data entry and display apparatus, a plurality of printing control elements included in the printing machine, each printing control element having actual and desired position values, a plurality of first optical elements arranged as a matrix which includes a plurality of rows and a plurality of columns, connected to said control elements, wherein each column represents a respective one of said printing control elements, and wherein each first optical element in said column represents a position value for a respective one of said printing control elements, a light pen having a contract point including a second optical element; said light pen being disposable so that said contact point is in optical contact with one of said first optical elements, and timing means operatively engaging said first and second optical elements for timingly coordinating the position of said contact point in said optical contact with a respective one of said first optical elements for entering a respective position value for said printing control element.

2. Data entry and display apparatus according to claim 1, wherein said printing control elements include ink feed control elements.

3. Data entry and display apparatus according to claim 1, wherein said printing control elements include dampening fluid control elements.

4. Data entry and display apparatus according to claim 1, wherein said printing control elements include register adjustment control elements.

5. Control apparatus according to claim 1, wherein each of said first optical elements is a light sender and wherein said second optical element is a light receiver.

6. Control apparatus according to claim 1, including a plurality of third optical elements wherein each of said first optical elements is a light sender, each of said third optical elements is a light receiver and said second light element is a light sender.

7. Apparatus for a printing machine according to claim 6, wherein each of said first optical elements is combined with a respective one of said third optical elements.

8. Apparatus according to claim 2, wherein each of the first optical elements is a liquid crystal element.

9. Apparatus according to claim 6, including a liquid crystal display panel, wherein said first and third optical elements are included in the liquid crystal display panel.

10. Apparatus according to claim 5, including a plurality of third optical elements each combined with a respective one of said first optical elements, wherein said first and third optical elements are light senders operating to respectively display said actual and said desired position value.

11. Apparatus according to claim 10, wherein each of said first and third optical elements are included in a CRT display.

12. Apparatus according to claim 2, wherein each of said first optical elements is included in a vacuum fluorescence display panel.

13. Apparatus according to claim 2 wherein each of said first optical elements is a light emitting diode.

14. Apparatus according to claim 10, wherein each of said first and third optical elements are included in a CRT display.

15. Apparatus according to claim 10, wherein each of said first and third optical elements are included in a vacuum fluorescence display panel.

16. Apparatus according to claim 10, wherein each of said first and third optical elements is a light-emitting diode (LED).

17. Apparatus according to claim 1 wherein said position values include feedback data representing the actual position values.

18. Apparatus according to claim 1 wherein said columns are disposed as vertical parallel stacks of first optical elements representing corresponding position values forming the horizontal rows.

19. Apparatus according to claim 1 wherein said plurality of columns is 32.

20. Apparatus according to claim 6 including a profile formed by activated third optical elements of adjacent columns, the profile representing a coherent position display for all printing control elements represented by the respective adjacent columns.

21. Apparatus according to claim 20 including a control panel, wherein said profile includes a step-profile, wherein a single position value entered by the light pen for one single printing control element is automatically transmitted to all printing control elements in a selected group of adjacent printing control elements in response to a step-profile command entered into said control panel.

22. Apparatus according to claim 21, wherein said selected group of adjacent control elements are represented by all corresponding columns disposed to one selected side of said single position value.

23. Apparatus according to claim 21, wherein said selected group of adjacent printing control elements are represented by all corresponding columns disposed to both the left and the right hand side of said single position value.

24. Apparatus according to claim 23, wherein the position value of the printing control elements to the left and right hand side may be reversed in response to a reversing command entered into said control panel.

25. Apparatus according to claim 5 comprising: short pulses produced by said timing means sequentially engaging all of said light senders, said short impulses operating to produce in the respective light senders light pulses that are too short to be perceived by the human eye, but long enough to be detected by the third optical element; long pulses produced by said timing means sequentially engaging selected light senders, said long pulses being long enough to produce a light pulse in the selected light senders to produce a visible light impression to the human eye: and inhibiting means responsive to said timing means for inhibiting the light pen optical element from responding to the long impulses.

26. Apparatus according to claim 25, wherein said short impulses sequentially engage said display elements in a controlled sequence at a controlled repetition rate, the apparatus including region-limiting means responsive to said timing means for defining a region of display elements being engaged by said short pulses, said region-limiting means including a regionally limited sequence of short cycles, the region including a given number of sequential display elements spaced apart from a selected contact point of the light pen by a given distance for decreasing the scanning time of the region.

27. Apparatus according to claim 1 wherein said position values are directed to preselected groups of printing control elements that are disposed directly to a left or right hand side of the contact point of the light pen.

28. Apparatus according to claim 6 wherein the third optical elements comprise light emitting diodes, said light emitting diodes operatively, timingly engaging said second optical element of the light pen for entering position values for the control elements.

29. Apparatus according to claim 6 including a plurality of servomotors, each engaging a respective one of said printing control elements, wherein said position value and changes thereto entered by the light pen are entered by placing the contact point of the light pen sequentially along selected ones of said first and third optical elements, said respective position value operating to actuate a respective servomotor connected to the respective printing control element, and to execute control commands.

30. Apparatus according to claim 1 wherein said respective position value is entered by the light pen in the direction of sequence of said printing control elements by moving the light pen in paths that include straight lines, stepped lines, and curved lines and control commands, said paths disposed to at least one of the left, the right and both sides of the contact point of the light pen.

31. Apparatus according to claim 28, further comprising means for manually entering position values and control commands for control of the servo motor.

32. Apparatus according to claim 1 including memory means for storing said position values and changes thereto and for storing intermediate values therein.

* * * * *